United States Patent [19]

Gregory

[11] 4,248,077

[45] Feb. 3, 1981

[54] JAW FOR RIVETER

[76] Inventor: Jack T. Gregory, P.O. Box 556, San Anselmo, Calif. 94960

[21] Appl. No.: 97,376

[22] Filed: Nov. 26, 1979

[51] Int. Cl.[3] ..... B21J 15/34

[52] U.S. Cl. ..... 72/391; 60/479; 72/453.17; 81/301

[58] Field of Search ..... 72/391, 453.15, 453.16, 72/453.17; 29/243.53, 243.54; 81/301; 60/477, 478, 479

[56] References Cited

U.S. PATENT DOCUMENTS

| | | | |
|---|---|---|---|
| 2,714,250 | 8/1955 | Twedt | 81/301 |
| 3,329,000 | 7/1967 | Schwab | 72/391 |
| 3,996,784 | 12/1976 | Champoux | 72/391 |
| 4,086,802 | 5/1978 | Ewig | 72/391 |

FOREIGN PATENT DOCUMENTS

| | | | |
|---|---|---|---|
| 664846 | 6/1963 | Canada | 60/477 |
| 1383794 | 2/1975 | United Kingdom | 60/477 |

*Primary Examiner*—Charlie T. Moon

*Attorney, Agent, or Firm*—Melvin R. Stidham

[57] ABSTRACT

In a hydraulic riveter wherein an extension on a piston carries a jaw holder containing an annular array of gripping segments with conical outer surfaces slidable on a conical inner surface of the holder, a second piston is slidable in a bore and is operative to force the segments along the wedging surface to grip a rivet. A fluid passageway brings the bore into communication with the cylinder, so that as pressure builds up in the cylinder to increase pulling force, the second piston is forced against the gripping segments with increasing force to build up clamping force on the rivet in direct relation to the pulling force of the tool.

4 Claims, 4 Drawing Figures

JAW FOR RIVETER

BACKGROUND OF THE INVENTION

In previous hydraulic riveters, gripping segments were wedged into clamping force around the rivet by means of a relatively constant biasing force, such as the spring. However, as pulling force on the rivet increased, the clamping members were often overcome, particularly as serrated gripping edges became worn.

OBJECTS OF THE INVENTION

It is an object of this invention to provide a hydraulic riveting tool with gripping jaws that increase gripping force as needed to resist slipping with increased pulling force.

It is a further object of this invention to provide a hydraulic riveting tool that will retain its gripping force under heavy loads.

Other objects and advantages of this invention will become apparent from the description to follow, particularly when read in conjunction with the accompanying drawing.

SUMMARY OF THE INVENTION

In carrying out this invention, I provide a hydraulic riveter wherein jaw segments are carried in a jaw holder on an extension to the piston. The inner surface of the jaw holder and the outer surfaces of the gripping segments are conical so that as the segments are forced in one direction they are wedged radially inward to increase gripping force on the shank of a rivet. A bore in the piston extension opens into communication with the cylinder itself and carries a pusher piston that is engageable with and biases the back of the gripping segments. Hence, as pressure builds up in the main cylinder to increase pulling force, the pusher piston is driven against the gripping segments with increasing force to tighten the grip on the rivet shank. A spring acts against the jaw holder in opposition to the pressure fluid to return the jaw holder when pressure is relieved. Complementary wedging surfaces on a nosepiece and on the jaw segments retracts the jaw segments and separates them radially when the jaw holder is so retracted.

DESCRIPTION OF A PREFERRED EMBODIMENT

Figure 2:
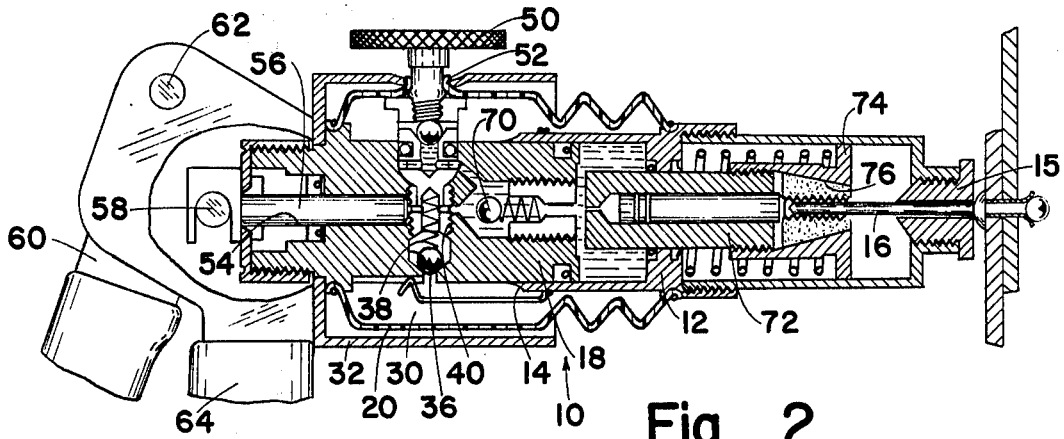
FIG. 2 is a section view of the riveter with jaws clamped.

Referring now to the drawing with greater particularity, the hydraulic riveter 10 of this invention includes a cylinder 12 which is open at one end 14 and at the other end, carries a nosepiece 15. The nosepiece 15 has an opening therethrough just large enough to receive the mandrel or shank 16 of a blind rivet.

Extending partially into the cylinder 12 and slidable therein is a piston 18, and sealed between the piston 18 and the cylinder 12 is a flexible, extensible sleeve 20 having a bellows portion 22 to facilitate extension, as the cylinder 12 and piston 18 move relative to each other. The extensible sleeve 20 is sealed at its opposite ends, with O-ring like lips 24 and 26 around the piston 18 and cylinder 12, respectively, and is spaced therefrom to form an annular reservoir 30 for hydraulic fluid. A plastic shroud 32 is secured over the reservoir sleeve 20 to protect it against puncture or other damage.

A radial bore 34 and counterbore 36 form a seat for a oneway, inlet ball check valve 37, which is biased by a spring 38 toward closed position. From the valve seat 36 the counterbore is tapped at 40 to threadedly receive an exhaust check valve assembly 42, leaving a clearance around it to form an inlet chamber 44. A ball check 46 is operable to seal off an exhaust passage 48 in the valve assembly 44.

In normal operation, a hand operated screw 50 forces the exhaust ball check 46 against its seat to prevent fluid from returning to the reservoir 30. An O-ring like seal 52 integral with the extendible sleeve 20 seals around the stem of the screw 50.

A longitudinal bore 54, which opens into the inlet chamber 44 from the end of the piston 18 slidable receives a pump plunger 56 which is pinned at 58 to a moving handle 60 which, in turn, is pivoted at 62 to a stationary handle 64. Also opening from the inlet chamber 44 is a pressure chamber 66, 68 which is normally closed by a transfer ball check valve 70.

Carried on an extension 72 on the piston 28 is a jaw holder 74 with an internal wedging surface 76 which acts against the outer surfaces of split jaws 78 to cause them to engage and grip the blind rivet 16. The jaws are biased against the beveled surface 76 by a pusher piston 80 slidable in a bore 82 in the extension 72. A port 84 opening into the bore 82 is in free communication with the pressure chamber 66, 68 so that when the plunger 56 is extended to unseat the ball check 70 and pressurize the cylinder 12, the bore 82 is also pressurized to cause the piston 80 to drive the jaws 78 against the wedging surface 76, forcing them inward to grip the rivet 16.

Figure 3:
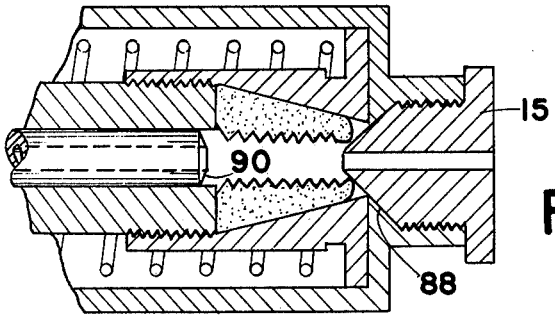
FIGS. 3 and 4 are enlarged partial section views of the jaws in different conditions of operation.
Figure 4:
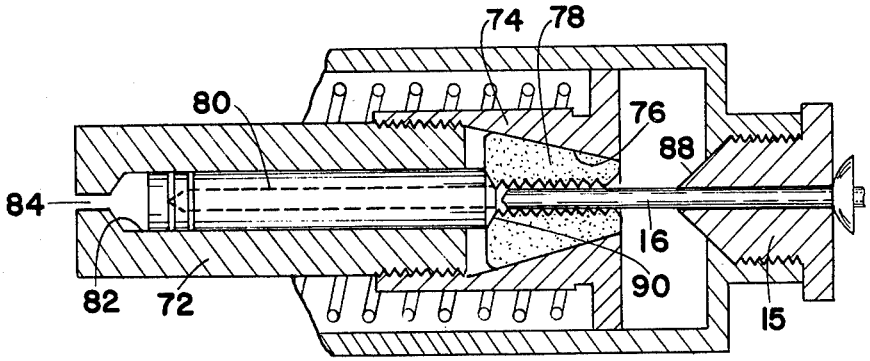
Figure 1:
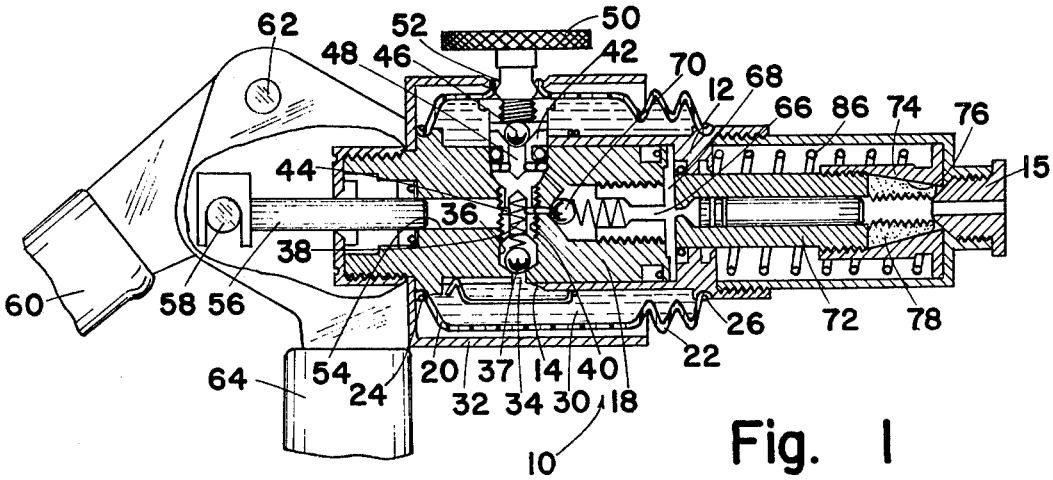
FIG. 1 is a section view of the hydraulic riveter of this invention with jaws relaxed prior to operation.

In operation, a blind rivet is inserted through the nose piece 14 and the jaw pusher 108 causes jaws to grip the mandrel 18. Then, the system is pressurized, as previously described, by pumping the moveable handle 68 to pressurize the chamber 66, 68 and move the main piston 18 to the left in FIG. 1, while the nose piece holds the rivet member 16 against the material to be riveted. The more pressure builds up to increase the pulling force on the rivet 16, the tighter the grip of the jaws 78. When the rivet is secured, the hand nut 50 is loosened to depressurize the chamber 66, 68, as well as the bore 82 and allow the spring 96 to return the cylinder 12 and piston 18 to their initial relative positions, shown in FIG. 1. When this occurs, wedging surfaces 88 and 90 on the nosepiece 15 and piston 80, respectively, (FIGS. 3 and 4) engage complementary wedging surfaces on the jaw segments 78 to pry them apart.

While this invention has been described in conjunction with a preferred embodiment thereof, it is obvious that modifications and changes therein may be made by those skilled in the art without departing from the spirit and scope of this invention as defined by the claims appended hereto.

Having described my invention, I claim:

1. In a hydraulic riveter including a cylinder with a piston slidable therein, a fluid reservoir, an inlet chamber, an inlet port between said reservoir and said inlet chamber, a transfer port between said inlet chamber and said cylinder, first and second one-way check valves in said inlet port and said transfer port, respectively, pump means for drawing fluid from said reservoir into said inlet chamber and forcing same from said inlet chamber to said cylinder, and jaw means for gripping the shank of a rivet as it is being pulled, said jaw means comprising:

an extension on one of said cylinder and piston;

an annular jaw holder on said extension having a conical inner surface converging toward one end thereof;

an annular array of gripping segments in said jaw holder having gripping elements on the inner surface thereof;

a bore in said extension;

a piston slidable in said bore and movable toward one end thereof to engage and bias said gripping segments; and a pressure port in the other end thereof opening into communication with said cylinder.

2. The combination defined by claim 1 wherein:

said pump means is operative to increase pressure in said cylinder progressively to increase force therein and said pressure port remains in continuous open communication.

3. The combination defined by claim 1 including:

complementary outer conical surfaces on said gripping segments.

4. The combination defined by claim 1 including:

a nose piece on the other of said cylinder and piston adapted to receive a rivet to be gripped by said jaw means;

said nose piece and said jaw means being forced apart by pressure fluid in said cylinder;

spring means opposing said pressure fluid; and complementary wedge surfaces on said nose piece and said jaw means to force said jaw segments apart and toward the other end of said jaw holder when said spring means overcome said pressure fluid.

* * * * *